United States Patent [19]

Ogino et al.

[11] Patent Number: 4,864,364

[45] Date of Patent: Sep. 5, 1989

[54] CHARGE ERASER FOR AN ELECTROPHOTOGRAPHIC COPIER

[75] Inventors: Shigeo Ogino; Keiji Nakatani; Tomoji Murata, all of Aichi, Japan

[73] Assignee: Minolta Camera Kabushiki Kaisha, Osaka, Japan

[21] Appl. No.: 138,512

[22] Filed: Dec. 23, 1987

[30] Foreign Application Priority Data

Dec. 27, 1986 [JP] Japan ..... 61-311185
Dec. 27, 1986 [JP] Japan ..... 61-311184

[51] Int. Cl.[4] ..... G03G 15/00
[52] U.S. Cl. ..... 355/202; 355/218
[58] Field of Search ..... 355/7, 1, 3 CH, 14 CH, 355/3 R; 354/5

[56] References Cited

U.S. PATENT DOCUMENTS

| | | | |
|---|---|---|---|
| 4,000,495 | 12/1976 | Pirtle | 354/5 X |
| 4,107,687 | 8/1978 | Pfeifer et al. | 354/5 X |
| 4,252,431 | 2/1981 | Cormier | 355/3 CH |
| 4,256,400 | 3/1981 | Komori et al. | 355/14 SH |
| 4,318,597 | 3/1982 | Kotani et al. | 355/1 X |
| 4,420,245 | 12/1983 | Katao | 355/1 X |
| 4,627,707 | 12/1986 | Tani et al. | 355/3 R X |
| 4,640,601 | 2/1987 | Deguchi et al. | 355/7 X |
| 4,701,044 | 10/1987 | Horiuchi et al. | 355/7 |
| 4,734,734 | 3/1988 | Yano | 355/7 X |

FOREIGN PATENT DOCUMENTS 130782 3/1985 Japan .

OTHER PUBLICATIONS

U.S. Ser. No. 793,587, Filed Oct. 31, 1985, now U.S. Pat. No. 4,752,809.

*Primary Examiner*—A. T. Grimley
*Assistant Examiner*—Robert Beatty
*Attorney, Agent, or Firm*—Price, Gess & Ubell

[57] ABSTRACT

An improved charger eraser assembly for an electrophotographic copying machine is provided. In a first mode of operation selected by the user, a uniform erasure of a predetermined area of the photoreceptor drum can be accomplished. In a second mode of operation, an imprinting of alphanumeric information on the photoreceptor drum can be achieved. The illumination emitting unit includes a plurality of individual controllable light emitting elements. The illumination emitting unit can be controlled to be moved relative to the photoreceptor drum to permit the light rays of adjacent light emitting elements to either overlap or to abut each other on the photoreceptor drum. Alternatively, a lens array can be inserted in the optical path for controlling the position of the light rays of the adjacent elements.

12 Claims, 8 Drawing Sheets

| Fig. 8(a) |
| --- |
| Fig. 8(b) |

CHARGE ERASER FOR AN ELECTROPHOTOGRAPHIC COPIER

BACKGROUND OF THE INVENTION

1. Field of the Invention

The present invention generally relates to an electrophotographic copying machine and, more particularly, to a charge eraser designed to erase by illumination at least a predetermined portion of the electrostatic charge built up on a photoreceptor drum in the copying machine.

-2. Description of the Prior Art

The electrophotographic copying machine now available in the market generally has an charge eraser disposed in the vicinity of the photoreceptor drum and positioned upstream of the developing station with respect to the direction of rotation of the photoreceptor drum. This type of charge eraser is used to illuminate at least partially the photosensitive surface of the photoreceptor drum to remove a charged portion, before the electrostatic latent image formed by exposing the photosensitive surface to image rays that correspond to an image to be copied is developed into a toned image. Thereby an unwanted portion of the electrostatic charge built up on the photosensitive surface will be prevented from being electrostatically coated with toner particles. The unwanted portion of the electrostatic charge to be removed or erased by illumination has long been chosen as a peripheral marginal portion of a copying paper generally outside the region of the latent image, and the charge eraser has been so designed and so positioned for this purpose.

On the other hand, demands have been made for the copying machine to have a capability of erasing not only the unwanted portion of the electrostatic charge, but also a portion of the electrostatic charge within the region of the latent image so that an operator of the copying machine can enjoy such effects as partial erasing, trimming, and composite copying. For example, given a certain image of particular size, the partial erasing will result in a blank left within a selected area of the image; the trimming would result in reduction in size of the image by the removal of an unwanted marginal area of the image; and the composite copying would result in the formation of a "window" on a selected area of the latent image for accommodating a different image which will be subsequently copied on the partially erased area of the image.

In order to meet the demands, the use of a charge eraser has been made, which eraser comprises a generally linear array of light emitting elements such as, for example, light emitting diodes, arranged in the vicinity of the photoreceptor drum so as to extend parallel to the axis of rotation of the photoreceptor drum. The light emitting elements are controlled by a matrix drive circuit so as to be selectively energized to emit rays of light to remove, in a predetermined pattern, a portion of the electrostatic charge on the photoreceptor drum.

Apart from the capability of making a window on the electrostatic charge built up on the photosensitive surface of the photoreceptor drum, the provision has been desired of a capability of imprinting the date, symbols and/or a brief commentary on the copying paper together with the copied image. This could possibly be accomplished if the light emitting elements are selectively energized to delineate alphanumeric characters with light beams so that portions of the electrostatic charge corresponding in pattern to the alphanumeric characters can be formed on the photosensitive surface of the photoreceptor drum.

Where the electrophotographic copying machine is to be fabricated having these two capabilities, care is required because the preciseness to which design requirements have to be fulfilled differs between these two capabilities. This will be discussed in detail with particular reference to FIG. 15 of the accompanying drawings, which illustrates the prior art charge eraser in fragmentary representation.

Referring to FIG. 15, the prior art charge eraser comprises a generally rectangular housing having a row of chambers isolated by partitions and accommodates therein respective light sources, such as light emitting diodes. According to the prior art, the charge eraser is so designed and so supported that the front of the housing with respect to the direction of projection of rays of light from the respective light sources may be spaced about 3 mm from the photosensitive surface of the photoreceptor drum. This is because, if the front of the housing is too close to the photosensitive surface of the photoreceptor drum so as to overlap rays of light emitted from the neighboring light sources with each other, the intensity of light projected from one or more of the LED light sources onto the photosensitive surface may vary from place to place on the photosensitive surface, accompanied by corresponding variation of the surface potential on the photosensitive surface, i.e., the potential of one or more portions of the electrostatic charge which are required to be removed from the photosensitive surface. The variation in potential of the photosensitive surface would not result in the eventual reproduction of a high quality image on the copying paper.

The selection of about 3 mm for the spacing between the front of the housing and the photosensitive surface of the photoreceptor drum is base on the utilization of interference of light emitted from the neighboring members of the LED light sources thereby to minimize the variation of the potential of the photosensitive surface of the photoreceptor drum.

It has, however, been found that, when about 3 mm is chosen for the spacing, the sharpness of the boundary between the erased area and the non-erased area in the electrostatic charge built up on the photosensitive surface will be impaired even though the problem associated with the varying surface potential on the photosensitive surface can be successfully eliminated. This in turn brings about a problem in that, when, for example, a certain character is to be imprinted, the character electrophotographically reproduced on the copying paper might be blurred as shown in FIG. 14(*b*).

SUMMARY OF THE INVENTION

Accordingly, the present invention has been developed with a view to substantially eliminating the above discussed problems inherent in the prior art charge eraser and has for its essential object to provide an improved charge eraser for an electrophotographic copying machine, which eraser is effective to clearly delineate alphanumeric characters opto-electrically on the photosensitive surface and also effective to illuminate the photosensitive surface uniformly without substantially creating any variation in potential (that is, ripple) at local portions of the photosensitive surface when the electrostatic latent image is "edited", that is, partially erased for trimming, or any other purpose.

According to a preferred embodiment of the present invention, the improved charge eraser herein disclosed for the electrophotographic copying machine comprises a generally rectangular box-like casing positioned in the vicinity of the periphery of the photoreceptor drum with its longitudinal axis lying parallel to the dimension of rotation of the photoreceptor drum and between the electrostatic charger and the developer unit. The casing has a row of individually controllable light emitting elements accommodated therein, which row extends parallel to the axis of rotation of the photoreceptor drum and is so supported and so positioned that light beams produced from the respective light emitting elements can impinge upon the photosensitive surface of the photoreceptor drum in a direction generally at right angles thereto. The charge eraser referred to above also comprises a drive means for driving the casing to adjust the surface area of the photosensitive surface onto which each light beam from the associated light emitting elements is projected according to a control signal applied thereto.

The light emitting elements which may be used in the present invention may be light emitting diodes, lamps, fluorescent display elements or any other light emitting elements known to those skilled in the art. A drive circuit for driving the light emitting elements may be of any design provided that the light emitting elements can be selectively controlled according to a signal fed from a control means.

The drive means which may be used in the present invention may be of any suitable design provided that the casing can be moved a predetermined distance either in a direction close towards and away from the photoreceptor drum or in a direction perpendicular to the axis of rotation of the photoreceptor drum in response to the control signal thereby to adjust the surface area of the photosensitive surface where each light beam is projected. The control signal referred to above may be available from, for example, a control CPU of an editor input device. This drive means may be integrated together with the charge eraser, but may not be limited thereto and the position of the drive means may be chosen at the will of a designer.

According to the present invention, where the partial erasure or trimming is desired to be performed, the eraser casing is either moved to have a spacing of about 3 mm between the front of the casing and the photosensitive surface of the photoreceptor drum, or rotated to cause light beams from the selected light emitting elements to spread over the photoreceptor drum, so that light beams from the selected light emitting elements can be cast upon the photosensitive surface of the photoreceptor drum.

On the other hand, where one or more alphanumeric characters are desired to be imprinted, the eraser casing is, in response to the control signal, either moved close towards the photoreceptor drum to a position at which the front of the casing is spaced about, for example, 1 mm from the photosensitive surface of the photoreceptor drum, or rotated to cause the light beams from the selected light emitting elements to impinge upon the photosensitive surface in a direction generally at right angles thereto, so that rays of light emitted from neighboring light emitting elements abut each other on the photoreceptor drum without overlapping.

In this way, any possible localized ripple can be advantageously avoided during the editing mode of operation of the copying machine. In other words, one or more portions of the electrostatic charge on the photosensitive surface can be removed by illumination produced by the selected light emitting elements such as, for example, light emitting diodes, to avoid adherence of toner particles to such portions of the photosensitive surface.

Also, according to another preferred embodiment of the present invention, the improved charge eraser herein disclosed for the electrophotographic copying machine comprises a generally rectangular box-like casing positioned in the vicinity of the periphery of the photoreceptor drum with its longitudinal dimension lying parallel to the dimension of rotation of the photoreceptor drum and between the electrostatic charger and the developer unit. The casing has a row of individually controllable light emitting elements accommodated therein, said row extends parallel to the axis of rotation of the photoreceptor drum and is so supported and so positioned that light beams produced from the respective light emitting elements can impinge upon the photosensitive surface of the photoreceptor drum in a direction generally at right angles thereto. The charge eraser also comprises a lens array for avoiding diffusion of light emitting from the light emitting elements and a drive means for driving the lens array between operative and inoperative positions. The lens array when in the operative position is interposed between the eraser casing and the photoreceptor drum.

The lens array which may be used in the present invention may be of any construction effective to avoid diffusion of light and may be preferably employed in the form of a bundle of optical fibers known as a trade name "SELFOC" in the market.

The drive means used in the practice of the second preferred embodiment may be similar in construction to that used in the practice of the first preferred embodiment in that it may be controlled in response to the control signal fed from the control CPU of the editor input device.

According to the second preferred embodiment of the present invention, the lens array will not be held at the operative position when and so long as the partial erasure or trimming is desired to be performed. However, where one or more alphanumeric characters are desired to be imprinted, the lens array is, in response to the control signal, moved to the operative position intervening between the eraser casing and the photoreceptor drum to avoid any possible diffusion of rays of light emitted from the selected light emitting elements.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENTS

Figure 1:
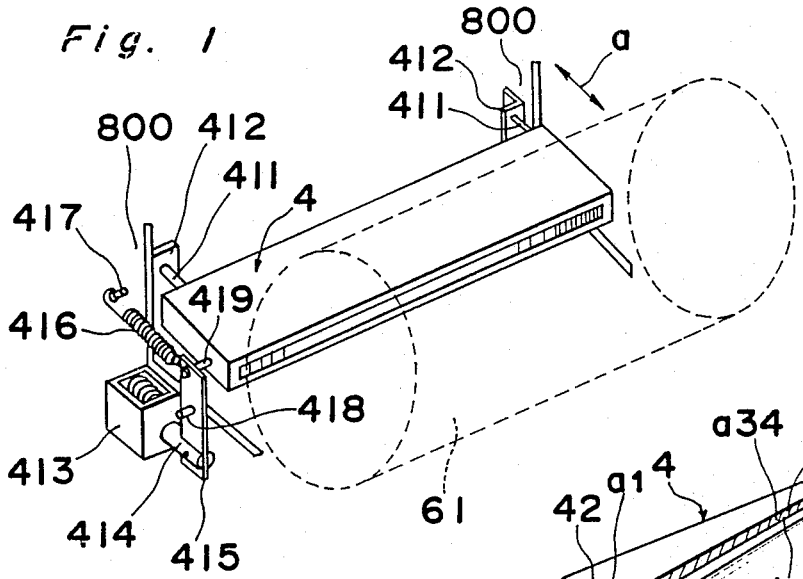
FIG. 1 is a schematic perspective view of a charge eraser according to a first preferred embodiment of the present invention.

Before the description of the present invention proceeds, it is to be noted that like parts are designated by like reference numerals throughout the several views of the accompanying drawings.

An electrophotographic copying machine to which the present invention is applicable may be of any known construction and includes a photoreceptor drum 61 (FIGS. 1 and 2) supported for rotation in one direction past a plurality of processing stations. These processing stations includes, inter alia, an electrostatic charging station at which an electrostatic charger is disposed for building an electrostatic charge on an outer peripheral surface of the photoreceptor drum 61, an exposing station at which image-wise rays of light descriptive of information to be copied are projected onto the outer peripheral surface of the photoreceptor drum 61 to form an electrostatic latent image thereon, and a developing station at which a developer is disposed to apply toner particles onto the outer peripheral surface of the drum to form a toned image corresponding to the electrostatic latent image. However, the details of the copying machine to which the present invention is applied will be discussed later with reference to FIG. 6.

Figure 2:
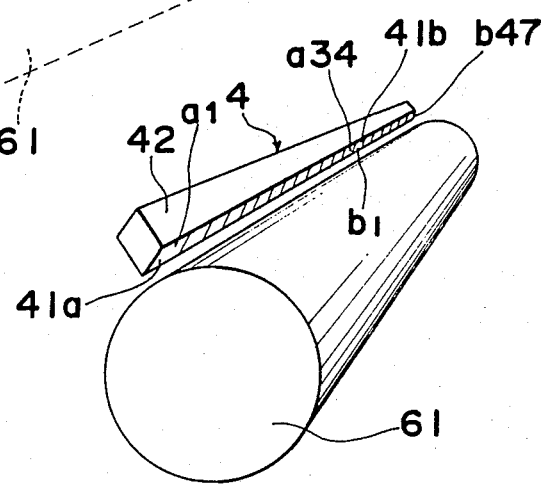
FIG. 2 is a schematic perspective view showing the charge eraser of FIG. 1 in relation to a photoreceptor drum used in the electrophotographic copying machine.

Referring now to FIGS. 1 and 2, a charge eraser according to a first preferred embodiment of the present invention, generally identified by 4, comprises a generally elongated box-like casing 42 having two groups of a plurality of light output cells in which respective light emitting diodes are accommodated, one group of the light output cells being generally identified by 41*a* and the other group of the light output cells being generally identified by 41*b*, all of said light output cells 41*a* and 41*b* opening towards the photoreceptor drum 61. For the purpose of the discussion of the preferred embodiment of the present invention, the number of the light output cells 41*a* is assumed to be 34 and that of the light output cells 41*b* is assumed to be 47.

The group of the light output cells 41*a* and the group of the light output cells 41*b* assume, in the instance as shown, left-hand and right-hand end portions of the elongated casing 42 as viewed therein and differ from each other in that each neighboring light output cells 41*a* are spaced a predetermined pitch of, for example, 5 mm from each other while the each neighboring light output cells 41*b* are spaced a predetermined pitch of, for example, 1 mm from each other. Thus, it will readily be understood that each of the light output cells 41*a* has a greater width, as measured in the direction lengthwise of the elongated casing 42, than that of each of the light output cells 41*b*.

The eraser casing 42 has built therein a drive circuit which will be described later with reference to FIG. 4 and which is electrically connected with an electric power source and a central processing unit for the control of the charge eraser 4.

The eraser casing 42 has spaced apart guide rods 411 protruding from the opposite end portions of a rear wall thereof in a direction counter to the direction towards the photoreceptor drum 61, which guide rods 411 in turn extend slidably through guide holes formed in associated angle members 412 rigid or fast with a framework of the copying machine so that the eraser casing 42 can be reciprocated in a direction shown by the arrow a. The eraser casing 42 also has at least one pin 419 protruding from one of the opposite end walls of the casing 42 in a direction parallel to the longitudinal sense of the casing 42 and positioned adjacent the light output cells, said pin 419 being in turn engaged in a hole defined in a link member 415.

The link member 415 is pivotally supported at a substantially intermediate portion thereof by means of a support pin 418 and is connected at one end with the pin 419 and at the other end with a solenoid plunger 414 built in a solenoid unit 413, said plunger 414 being movable between projected and retracted positions. A tension spring 416 extends between the end of the link member 415 adjacent the pin 419 and a pin 417 fixed to the framework 800 of the copying machine and acts to hold the plunger 414 at the projected position in which condition the eraser casing 42 is held at a position away from the photoreceptor drum 61. However, when the solenoid unit 416 is electrically powered, the plunger 414 is moved to the retracted position inwardly of the solenoid unit 413 against the pulling force of the tension spring 416 with the consequence that the eraser casing 42 is moved in a direction towards the photoreceptor drum 61.

The eraser casing 42 of the construction described above is so positioned in the vicinity of the photoreceptor drum 61 and so supported that a beam of light from each of the light emitting elements within the eraser casing 42 can impinge upon the photosensitive surface of the photoreceptor drum 61 generally at right angles thereto.

The imprinting of a character or the partial erasure of the electrostatic charge that is performed by the charge eraser 4 can be realized in the following manner.

Figure 3:
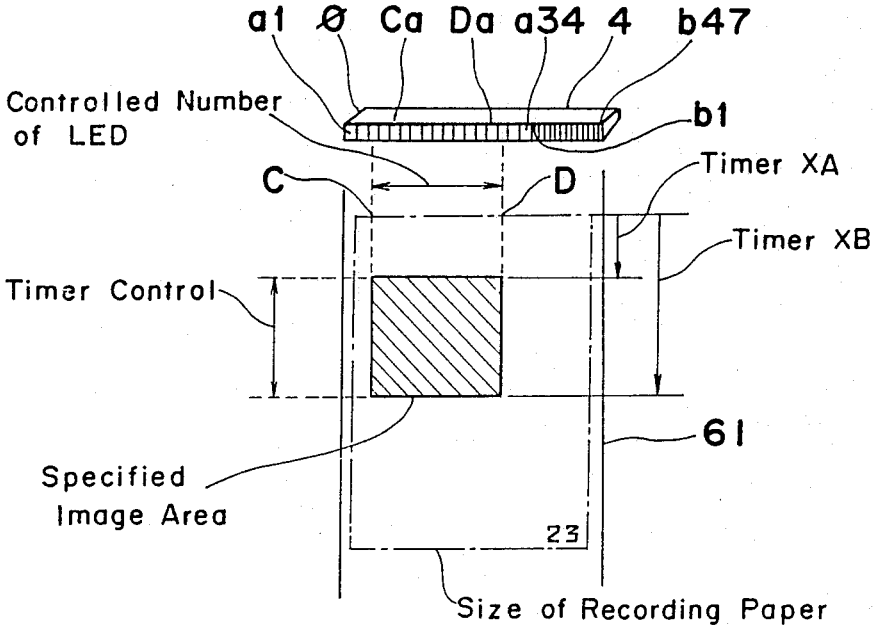
FIG. 3 is a schematic diagram used to explain how an alphanumeric character can be imprinted with the charge eraser.

Referring to FIG. 3, assuming that the 34 light emitting diodes in the light output cell 41*a*, having a larger width, are designated by a1, a2, . . . a33 and a34 as shown, and when some of these light emitting diodes falling within Ca to Da are turned on to illuminate the photosensitive surface of the photoreceptor drum 61 during a period from the timing of termination of a timer XA to the timing of termination of a timer XB, a portion of the electrostatic charge built up on the photosensitive surface of the photoreceptor drum 61 which is shown by a shaded area in FIG. 3 can be removed. Because of this, no toner is attracted to such portion of the electrostatic charge on the photosensitive surface during the subsequent developing process and, accordingly, when looking at the resultant copy made, a portion of the copy corresponding in position to that portion of the photosensitive surface from which the electrostatic charge has been dissipated by the charge eraser 4 is left blank with no image reproduced.

Figure 7:
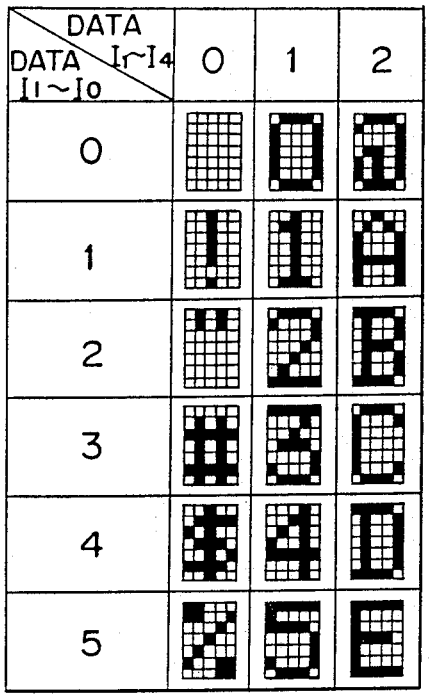
FIG. 7 is a schematic diagram showing a font pattern.

When it comes to the imprinting of the character, it can be achieved by selectively switching on and off the 47 light emitting diodes b1 to b47 within the light output cells of smaller width so that portions of the electrostatic charge built up on the photosensitive surface of the photo-receptor drum 61 can be removed in a pattern corresponding to the shape of the character desired to be imprinted, for example, in a pattern of the reversed shape of "23" if "23" is desired to be imprinted. The selective switching on and off of the 47 light emitting diodes can be accomplished by, for example, by storing such a font pattern as shown in FIG. 7 in a memory and, then, keying in some selected keys on a keyboard to read the font pattern out from the memory to form a bit map so that selected commands can be generated from the bit map. It is to be noted that FIG. 7 illustrates only a portion of the font patterns to be written in the memory for the purpose of discussion of the present invention, each of said font patterns being composed of 5×7 dots.

The reason that the number of the light emitting diodes within the light output cells of smaller width is selected to be 47 in the instance discussed above, is because a maximum of eight characters each having a character width equal to the sum of five dots can be imprinted in a side-by-side relationship. Therefore, where more or less than the eight characters are desired to be imprinted or where the number of dots determinative of the character width is greater or smaller than the five dots, the number of the light emitting diodes actually used may vary correspondingly.

Figure 4:
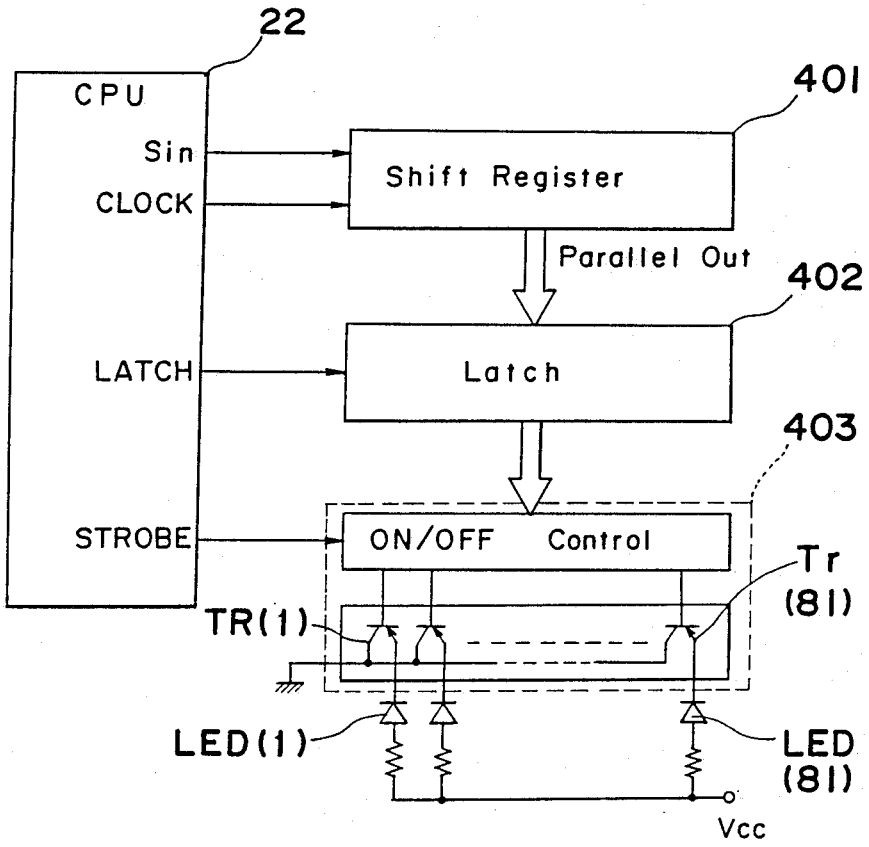
FIG. 4 is a circuit block diagram showing a drive circuit for the charge eraser.

With reference to FIG. 4, an eraser drive circuit will now be described. The eraser drive circuit includes a shift register 401, a latch 402 and a driver 403, all of which are controlled by respective signals, fed from a central processing unit 22 for the control of the charge eraser, for controlling the selective switching on and off of drive transistors Tr(1) to Tr(81).

Each of the light emitting elements LED(1) to LED(81) is driven by a power source voltage Vcc.

Figure 6:
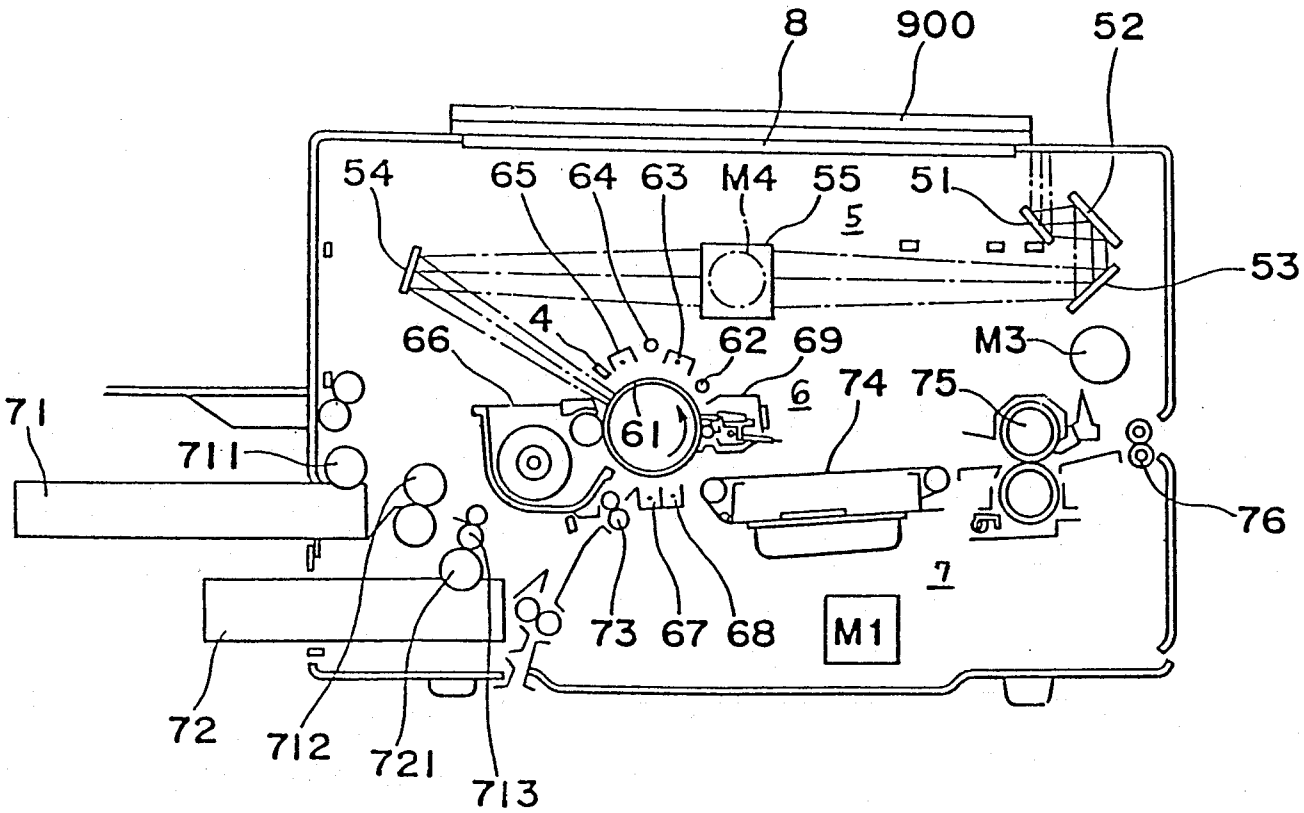
FIG. 6 is a schematic side view of the copying machine to which the present invention is applied.

The structural details of the copying machine to which the present invention is applied will now be described with reference to FIG. 6. The illustrated copying machine incorporating the charge eraser according to the foregoing embodiment therein comprises an optical system 5 operable to scan the document to be copied while illuminating the same, an electrophotographic system 6 for reproducing an image of the document on a copying paper through the electrophotographic process, a paper supply and toner fixing system 7, and a transparent document support 8 in the form of a glass plate. Hereinafter, these systems will be individually discussed under respective headings.

(A) Optical System 5

The optical system 5 comprises a source of light (not shown), a plurality of reflecting mirrors 51, 52, 53 and 54, a lens assembly 55 and a drive mechanism (not shown) and is operable to reciprocally move between home and scanned positions, said optical system scanning the document placed on the document support 8 while illuminating the same during the movement thereof from the home position towards the scanned position. More specifically, rays of light reflected from the document are, after having been reflected by the mirrors 51 to 53, allowed to pass through the lens assembly (a magnification variable lens block) and are then reflected by the mirror 54 so as to travel towards the photoreceptor drum 61, thereby forming an image of the document on the photosensitive surface of the photoreceptor drum 61. The mirrors 51 to 53 are adapted to be simultaneously driven by a common drive motor M3, the mirror 51 being driven at a speed equal to v/n and the mirrors 52 and 53 being driven at a speed equal to v/2n for maintaining the optical paths at a constant length, wherein v represents the peripheral velocity of the photoreceptor drum 61 and n represents the magnification factor. On the other hand, the mirror 54 and the lens assembly 55 are driven in association with each other by a magnification setting motor M4 in such a way that the lens assembly 55 is moved to any desired position in a direction parallel to the optical axis thereof for the selection of a particular magnification factor while the mirror 54 serves to compensate for any possible variation in the image forming point which would result from the movement of the lens assembly 55.

(b) Image Forming System 6

In addition to the photoreceptor drum 61 adapted to be driven in one direction shown by the arrow, the image forming system 6 includes a main eraser lamp 62, an auxiliary electrostatic charger 63, an auxiliary eraser lamp 64, a main electrostatic charger 65, a developing unit 66, a transfer charger 67, a separation charger 68 for copying papers and blade-type cleaning unit 69, all disposed around and in the vicinity of the photoreceptor drum 61.

The charge eraser 4 according to the present embodiment is disposed in the vicinity of the photoreceptor drum 61 at a location between the main electrostatic charger 65 and the developing unit 66. It is to be noted that, although the position of the charge eraser 4 is, in the illustrated instance, closer to the main electrostatic charger 65 than to the image exposure station, it may be closer to the developing unit 66. In other words, the position of the charge eraser 4 may be such that illumination by the charge eraser 4 can be effected after the photosensitive surface of the photoreceptor drum 61 has been uniformly electrostatically charged and before the developing is performed by the developing unit 66.

As the photoreceptor drum 61 being rotated passes sequentially past the eraser lamps 62 and 64 and the electrostatic chargers 63 and 65, the photosensitive surface of the photoreceptor drum 61 is increasingly sensitized and electrostatically charged and an electrostatic latent image is then formed upon receipt of the imagewise rays of light from the optical system 5 through an exposure slit.

At the subsequent developing station, the latent image on the photosensitive surface of the photoreceptor drum 61 is applied with toner particles to form a toned image which is in turn transferred onto the copying paper (the one supplied through a timing roller 73 of the paper supply and ejecting system 7) at the transfer station.

(c) Paper Supply and Ejecting System 7

The paper supply and ejecting system 7 comprises an upper paper cassette 71 and a lower paper cassette 72, paired feed rollers 711 and 721 for the respective cassettes 71 and 72, paired conveyance rollers 712 and 713, the timing roller 73, a transport belt 74, a fixing unit 75, and paired delivery rollers 76, all of them being adapted to be driven by a drive motor M1.

It is to be noted that the toned image transferred onto the copying paper is heat-fixed as it passes through the paired rollers of the fixing unit 75.

Figure 5:
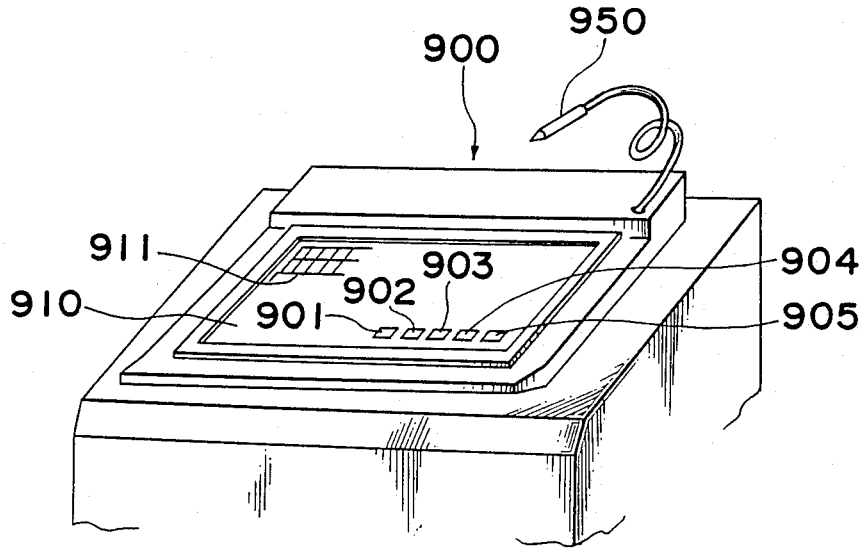
FIG. 5 is a schematic perspective view of a top portion of the copying machine, showing an editing input device placed on the copying machine.

Referring to FIG. 5, there is shown an editor 900 placed on the document support 8. This editor 900 is adapted to be electrically connected with the copying machine when placed on the document support 8 as shown in FIGS. 5 and 6.

As shown, the editor 900 includes a tablet 910 and a plurality of keys 901 to 905. The tablet 910 is generally rectangular in shape corresponding to the shape of the document support 8 and has a plurality of resistance wirings 911 extending in a mesh fashion in X-axis and Y-axis directions while each adjacent resistance wirings are spaced a predetermined interval, for example, about 1 mm, wherefore when a selected point of intersection between the X-axis resistance wirings and the Y-axis resistance wirings is pressed to shortcircuit, the resistance determined by the X-axis and Y-axis coordinates of such selected point of intersection can be detected in terms of the level of voltage. Accordingly, where a particular point on the document is desired to be inputted as a data of the X-axis and Y-axis coordinates, the document is to be placed on and retained in position above the tablet 910 and a desired point of intersection is to be then pressed.

The tablet 910 has imprinted thereon characters such as "A", "B", "C", . . . "Y" and "Z" or "1", "2", "3" . . . , which correspond to the fonts shown in FIG. 7, and a desired character can be selected in association with a character key 903 as will be described later.

The keys 901 to 905 represent an ERASE key, a TRIMMING key, a character key, an END key and a CLEAR key, respectively. The ERASE key 901 is used to specify a full erasure of a particular area; the TRIMMING key 902 is used to specify a full erasure of an area other than the particular area; the character key 903 is used to specify a character input mode; the END key 904 is used to terminate the inputting of the coordinates or character; and the CLEAR key 905 is used to clear all of the above mentioned specifications.

Hereinafter, the operation of the device according to the present embodiment will be described with particular reference to FIG. 8 comprised of FIGS. 8(*a*) and 8(*b*) which illustrate the sequence of control (control of the editor 900 and the eraser 4) performed by the central processing unit 22. It is to be noted that the control for the copying operation and the temperature adjustment is well known to those skilled in the art and, therefore, the description thereof will not be reiterated here.

As shown, the central processing unit 22 starts its operation when the electric power supply is initiated, initializing at step S102. During the initialization, the count of a counter m for counting the number of readings of the font pattern from a font memory, and the value of a counter n for counting the number of specifications of the coordinates are reset to zero. Also, each flag is lowered and each memory is cleared. Thereafter, a routine timer for determining the time for one routine is set at step S104.

Subsequently, at step S106, input and output are rendered to be active.

Then, at step S108, a decision is made in reference to an end flag to determine if the specification of the coordinates and the reading of the font pattern have been completed. Should the result of decision at step S108 indicates that the end flag has not been set up, that is, if the inputting of the data of the coordinates and/or the reading of the font pattern have not yet been completed, a process from step 112 to step 146 is executed.

At step S112, a decision is made to determine if a coordinate signal from the tablet 910 has been inputted. This can be accomplished by referring to the presence or absence of any variation of the data inputted from the tablet 910 through an Analog-to-Digital (A/D) converter (not shown).

If the result of decision at step S112 indicates the presence of the input, the program flow proceeds to step S114 on the condition that it is not in the character mode, that is, on the condition that a W flag is zero (step S113). At step 114, a decision is made to determine if the count of the counter n (the number of times of inputting of the coordinates) has reached 2. If the count has not yet reached 2, step S116 takes place at which the (X,Y) coordinates which have been inputted as described above is stored in a memory, followed by the increment of the count of the counter n by one at step S118, after which the program flow return to step S104. Since in the present embodiment a generally rectangular area is specified where the area is specified, the specification of the coordinate data would suffice at two points (opposite ends of the diagonal line) and, therefore, the upper-limit count of the counter n is fixed 2.

Where the result of decision at step S113 indicates that the W flag is 1, it means the character mode and, therefore, the program flow proceeds to step S132.

At step S132 a decision is made to determine if the count of the counter m (the number of reading of the font pattern) has reached 8. If it has not yet reached 8, step S136 takes place to read from the font memory the font pattern (See FIG. 7) corresponding to the character which is delineated at an area then pressed with a light pen 950 (FIG. 5), followed by step S138 at which a bit map for controlling the switching on and off of the eraser 4 is prepared on a bit map memory. Thereafter, at step S140, the count of the counter m is incremented by one, with the program flow subsequently returning to step S104. It is to be noted that the upperlimit count of the counter m which is 8 is determined by the number (47) of the light emitting diodes and the number (5) of dots for each character representative of the width thereof.

Should the result of decision at step S112 indicate the absence of input, the program flow proceeds to step S120, et seq.

At step S120, a decision is made to determine as to the presence or absence of input from the ERASE key 901. If the result of decision at this step indicates the presence of input, an E flag (erase flag) is set up at step S122, followed by the return to step S104. On the other hand, in the event of the absence of input, the program flow proceeds to step S124 at which a decision is made to determine as to the presence or presence of input from the TRIMMING key 902. In the event that the result of decision at step S124 indicates the presence of input, a T flag (trimming flag) is set up at step S126, followed by the return to step S104. In the event of the absence of input, the program flow proceeds to step S128.

At step S128 a decision is made to determine as to the presence or absence of input from a character mode key 903. If the result of decision at this step indicates the presence of input, a W flag (character mode flag) is set up at step S130, with the program flow returning to step S104. In the event of the absence of input, the program flow skips from step S128 to step S142.

At step S142 a decision is made to determine as to the presence or absence of input from the END key 904. If the result of decision at this step indicates the presence of input, the program flow returns to step S104 after the END flag has been set up at step S144 in view of the fact that the inputting of the data of the coordinates and/or the conversion from the data of the coordinates to the data of characters have been completed. In the event of the absence of input, however, the program flow proceeds from step S142 to step S104.

At step S146 a decision is made to determine as to the presence or absence of input from the CLEAR key 905. If the result of decision at this step indicates the presence of input, the program flow returns to step S102, but if it indicates the absence of input, the program flow returns to step S104 via step S146.

In this way, i.e., through the process from step S112 to step S146, the coordinate data and/or the character data (bit map) are stored in the bit map memory.

In the event that the result of decision at step S108 indicates that the end flag has been set up, that is, the coordinate data and/or the character data (bit map) have been stored in the bit map memory, the subsequent decision takes place at step S110 at which a decision is made to determine if the copying operation is executed.

Figures 8, 8A:
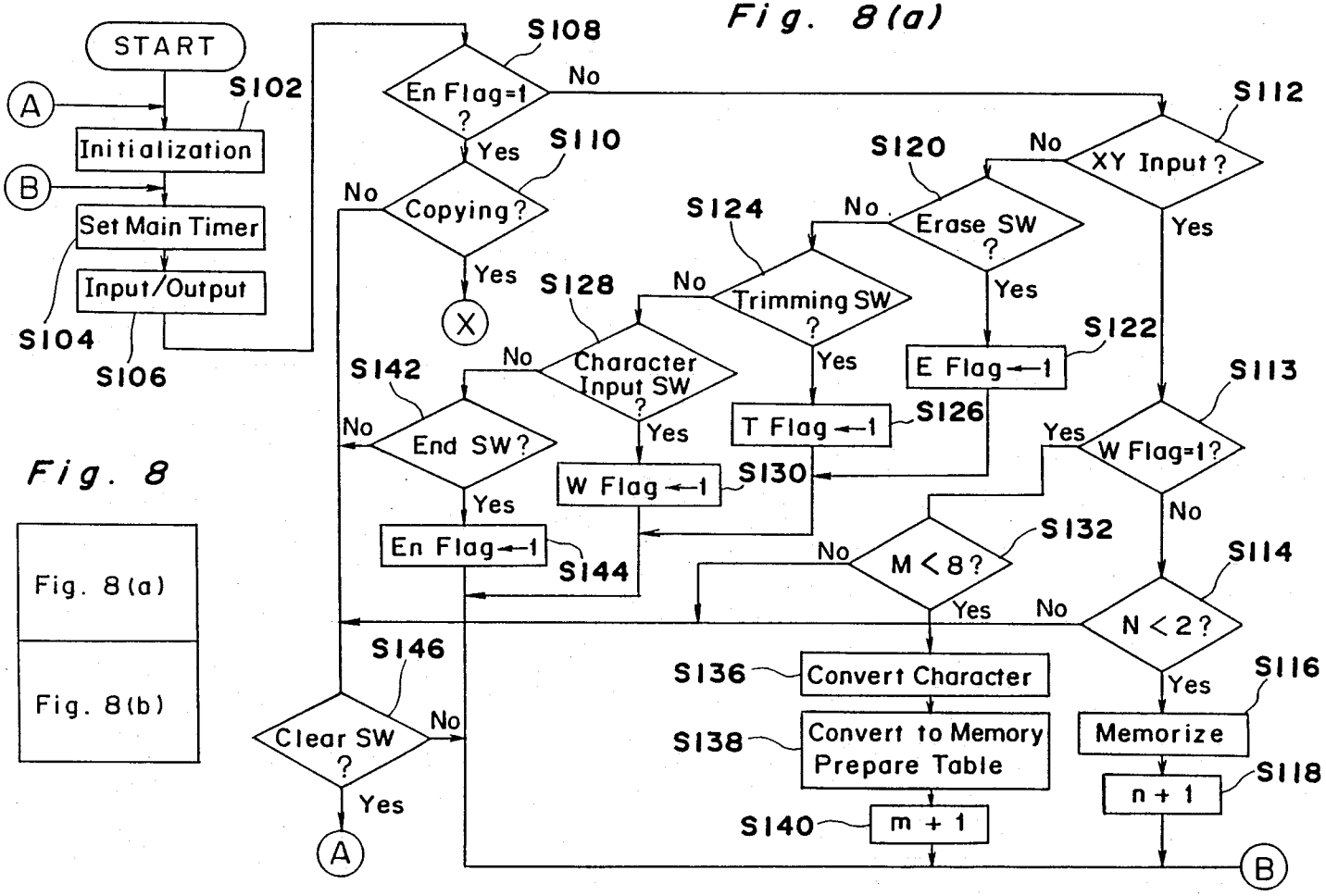
FIG. 8 comprised of FIGS. 8(*a*) and 8(*b*) is a flowchart showing the sequence of operation of a central processing unit.
Figure 8B:
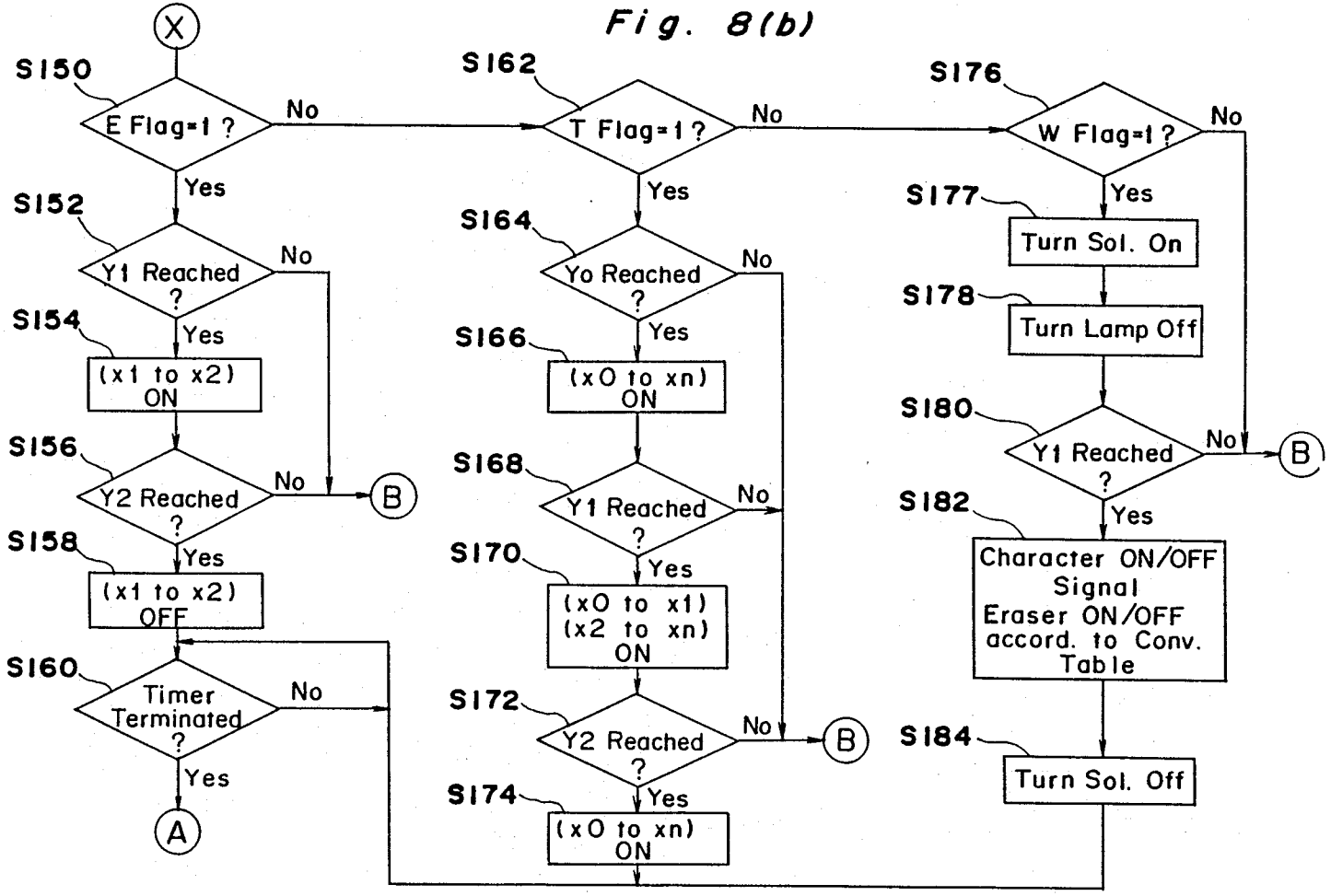

In the case where the copying operation is executed, the program flow proceeds to step S150, et seq., particularly as shown in FIG. 8(*b*).

The program flow from step S150 to step S158 represents a process in which the specified area is erase-controlled. Specifically, by switching on the light emitting diodes corresponding to coordinates x1 to x2 within a time period corresponding to coordinates y1 to y2, a square area having the opposite apexes represented by (x1, y1), (x2, y2) can be full erased.

On the other hand, the program flow from step S162 to step S174 represents a process in which the specified area is trimmed. Specifically, by switching off the light emitting elements x1 to x2 from y=y1 to y=y2 while switching on the other light emitting elements, an area other than the square area having the opposite apexes represented by (x1, y1), (x2, y2) can be erased.

The program flow from step S176 to step S184 represents a process in which in accordance with the bit map corresponding to the stored font pattern the light emitting diodes 35 to 81 of the charge eraser 4 are selectively switched on and off when and after y=y1 has been attained, to remove a portion of the electrostatic charge on the photoreceptor drum 61 in a pattern corresponding to a predetermined character pattern. Specifically, with the condition that the W flag has been set to 1 (step S176), the solenoid unit 413 (FIG. 1) is energized at step S177 to cause the eraser 4 to approach the photoreceptor drum 61 while an exposure lamp is switched off at step S178 in readiness for the character imprinting. Subsequent to step S180, the light emitting diodes of the eraser 4 are selectively switched on and off at step S182 according to the bit map table, prepared at step S138, to effect the character imprinting, followed by the deenergization of the solenoid unit 413 at step S184 to move the eraser 4 towards a reference position away from the photoreceptor drum 61.

In this way, the character pattern can be sharply delineated on the copying paper.

In the foregoing embodiment, the eraser has been described as supported for movement in a direction towards and away from the photoreceptor drum 61 along the path perpendicular to the axis of rotation of the photoreceptor drum 61. However, in the following embodiment which will now be described with reference to FIGS. 9 and 10, the eraser is supported for pivotal movement in a plane perpendicular to the axis of rotation of the photoreceptor drum 61 so that the distance between the front of the eraser and the photosensitive surface of the photoreceptor drum 61 can be varied to vary the area of surface of the photosensitive surface that is to be illuminated.

Figure 9:
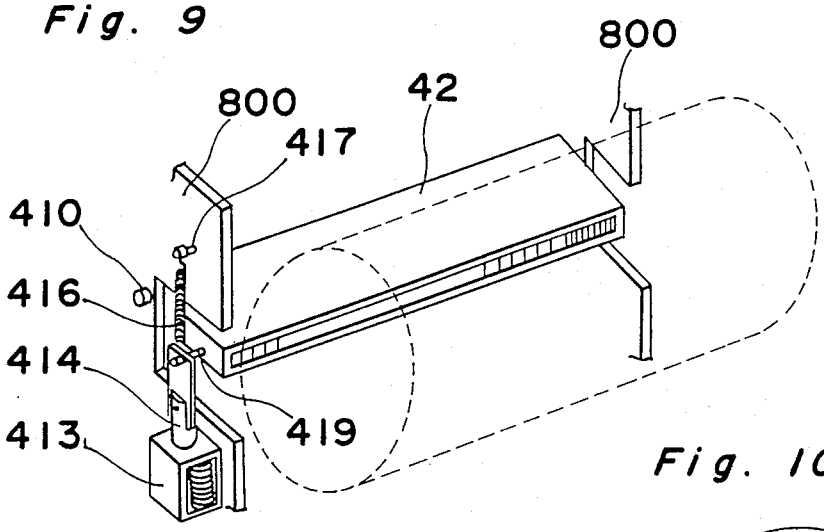
FIG. 9 is a view similar to FIG. 1, showing the charge eraser according to another preferred embodiment of the present invention.
Figure 10:
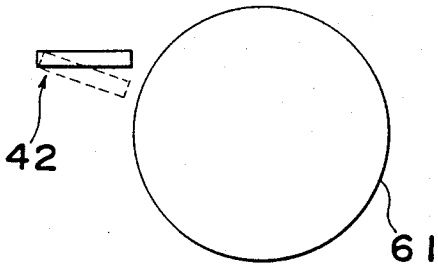
FIG. 10 is a schematic end view of the photoreceptor showing the positioning of the charge eraser relative thereto according to the second embodiment of the present invention.

In the embodiment shown in FIG. 9, the eraser casing 42 has stud pins 410 protruding from the opposite end walls thereof in a direction away from each other parallel to the longitudinal sense of the casing 42. These stud pins 410 are positioned on the opposite ends of the casing 42 adjacent a rear wall thereof remote from the photoreceptor drum 61 and are journaled to respective portions of the machine framework 800 so that the eraser can pivot between first and second positions about an axis coaxial with any one of the stud pins 410. The plunger 414 of the solenoid unit 413 is coupled with the pin 419 as is the case with the foregoing embodiment of FIG. 2, however, the solenoid unit 413 including the plunger 414 is so positioned and so supported that, when the solenoid unit 413 is energized with the plunger 414 moved to the retracted position, the eraser casing 42 is pivoted from the first position, shown by the solid line in FIG. 10, to the second position shown by the phantom line in FIG. 10 against the pulling force of the spring 416. However, when the solenoid unit 413 is deenergized, the plunger 414 is pulled to the projected position by the action of the spring 416 with the eraser casing 42 held at the first position shown by the solid line.

When the eraser casing 42 is held at the first position, the front of the charge eraser, that is, the openings of the light output cells of the eraser, is spaced a maximum distance from the area of the photosensitive surface that is to be illuminated thereby and, accordingly, the removal of a portion of the electrostatic charge on the photosensitive surface is possible with no ripple accompanied. On the other hand, when the eraser casing 42 is held at the second position, the front of the charge eraser is spaced a minimum distance from the area of the photosensitive surface to be illuminated and, accordingly, the removal of that portion of the electrostatic charge delimited by a clear and sharp boundary line is possible.

While in any one of the foregoing embodiments the eraser has been shown and described as movably supported, it may be supported stationary as will be described in connection with a third preferred embodiment of the present invention with particular reference to FIGS. 11 and 12.

Figure 11:
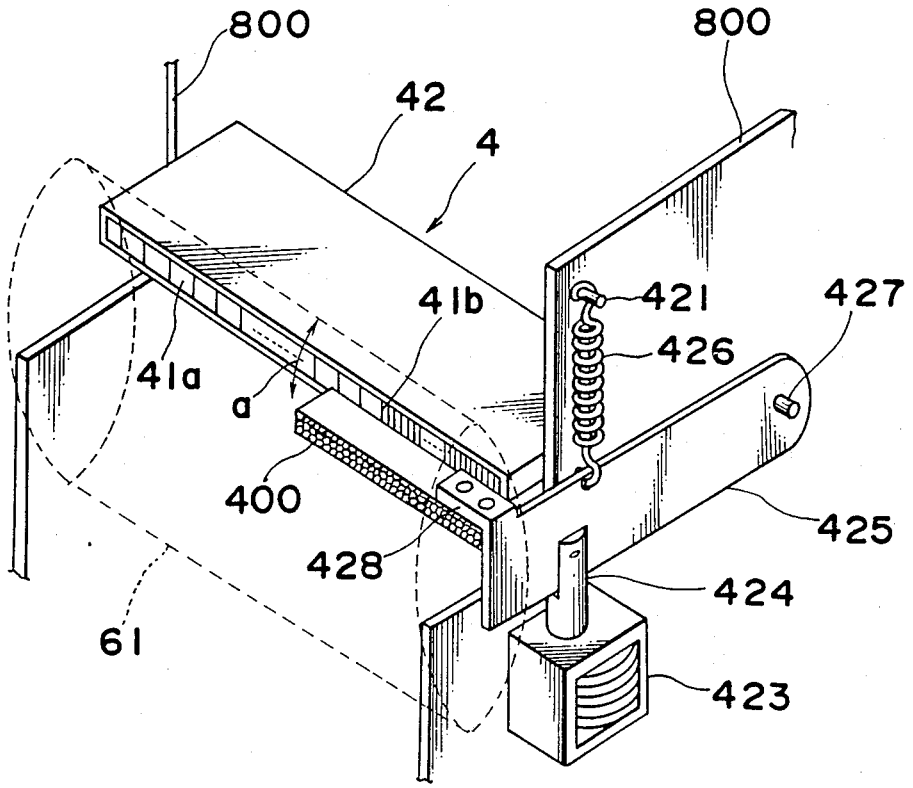
FIG. 11 is a schematic perspective view of the charge eraser according to a third preferred embodiment of the present invention.

As best shown in FIG. 11, the eraser casing 42 is supported stationary sandwiched between opposite wall members of the machine framework 800 with a substantial distance left between the front of the eraser 4 and the photosensitive surface of the photoreceptor drum 61. A Selfoc lens array (Trade Name) 400 is generally of a elongated configuration is shown and positioned within a space delimited between the photosensitive surface of the photoreceptor drum 61 and the eraser 4, having its longitudinal dimension enough to cover or overlap with the group of the light output cells 41*b*. This is Selfoc lens array is comprised of a plurality of optical fibers tied to provide a generally bundled configuration and is operable to render all of the rays of light passing therethrough to be parallel to each other as will be described later.

Figure 12:
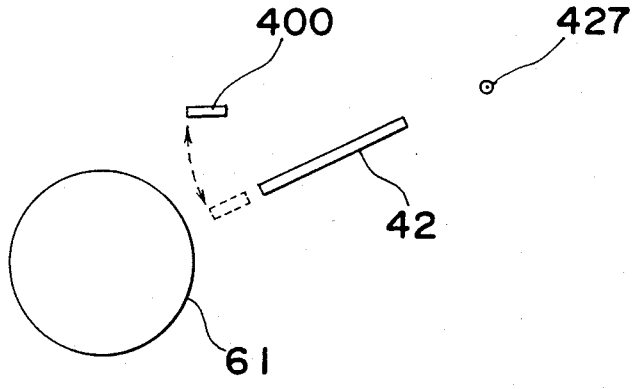
FIG. 12 is a view similar to FIG. 10, showing the charge eraser positioned relative to the photoreceptor drum according to the third embodiment of the present invention.

The lens array 400 is carried by the link 425 for movement between first and second positions shown by the solid line and the phantom line, respectively, in FIG. 12, said link 425 having one end connected to one of the wall members of the machine framework 800 through a pivot pin 427. The lens array 400 so supported is normally biased to the first position by the action of the spring 426, but can be pivoted about the pivot pin 427 to the second position against the spring 426 by the solenoid plunger 424 when the latter is moved to the retracted position as a result of the energization of the solenoid unit 423. It is, however, to be noted that instead of the use of the solenoid unit 423 including the plunger 424, a stepper motor may be employed for driving the lens array in a manner as hereinbefore described.

Figure 14A:
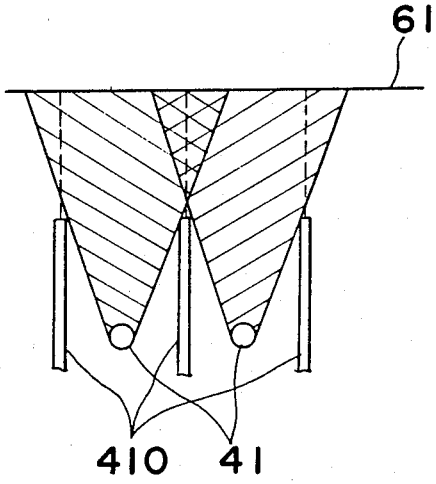
FIG. 14 is a view similar to FIG. 13, showing the case in which no lens array is used.
Figure 14B:
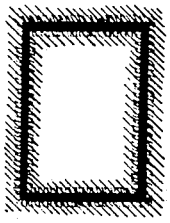
Figure 15:
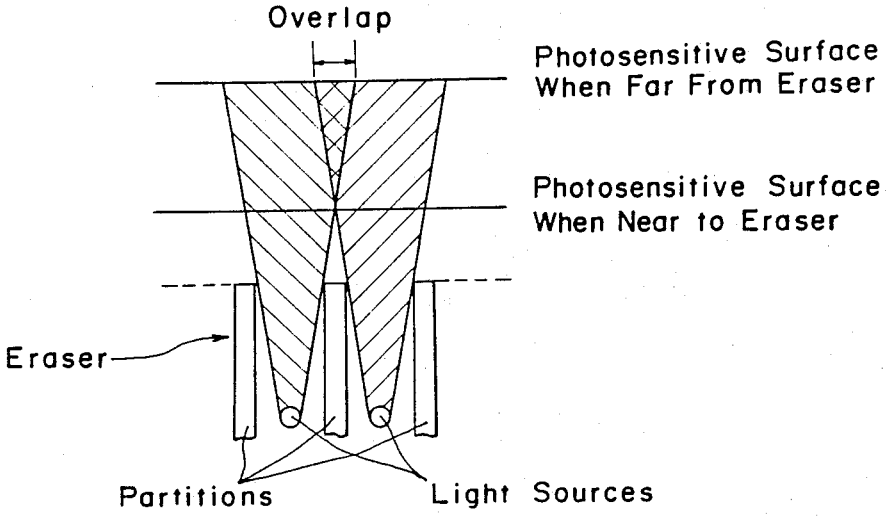
Fig. 15 Prior Art
FIG. 15 is a diagram used to explain the relationship of the distance between the charge eraser and the photoreceptor drum with the intensity of light projected onto the photosensitive surface of the photoreceptor drum.

When the lens array 400 is in the first position as shown by the solid line in FIG. 12, rays of light emitted from the LED light source 42 are, after having been restricted by the neighboring partitions 410 on respective sides of the LED light source 41, diffused before they reach the photosensitive surface of the photoreceptor drum 61 as shown in FIG. 14(*a*). Therefore, at the boundary, rays of light from the neighboring LED light sources overlap with each other with the consequence that a local variation of the potential can be lessened as shown in FIG. 14(*b*).

Figure 13A:
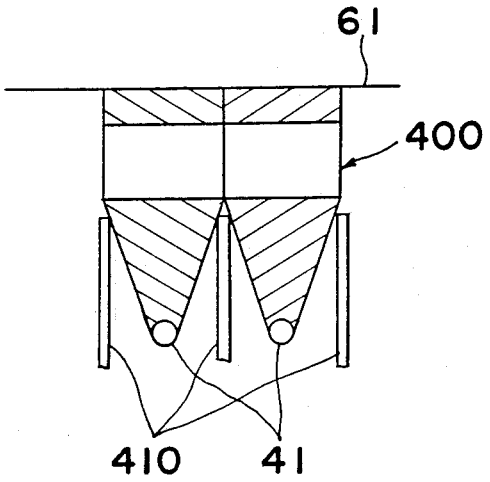
FIG. 13 is a schematic diagram showing the manner in which rays of light emitted from two light emitting elements used in the charge eraser according to the present invention are projected onto the photosensitive surface when a lens array is held at an operative position.
Figure 13B:
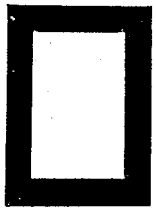

Conversely, when the lens array 400 is pivoted to the first position intervening between the drum 61 and the charge eraser 4, the rays of light emitted from the neighboring LED light sources 41 are, after having been restricted by the neighboring partitions 410 on the respective sides of the LED light source 41, rendered parallel to each other by the lens array before they reach the photosensitive surface of the photoreceptor drum 61 as shown in FIG. 13(*a*). Therefore, the rays of light from the respective LED light sources 41 do not overlap with each other at the boundary and the character can be clearly and sharply imprinted as shown in FIG. 13(*b*).

Except for the direction of movement of the eraser 4, the program flow shown in and described with reference to FIG. 8 can be equally employed for controlling the charge eraser 4 shown in and described with reference to FIG. 11.

Although the present invention has been fully described in connection with the preferred embodiments thereof with reference to the accompanying drawings, it is to be noted that various changes and modifications are apparent to those skilled in the art without departing from the scope of the present invention as defined by the appended claims. Such changes and modifications are to be understood as included within the scope of the present invention.

What is claimed is:

1. A charge eraser for use in an electrophotographic copying machine for illuminating a predetermined area of a peripheral surface of a photoreceptor drum to lower the potential of said predetermined area, comprising:

an illumination emitting unit including a plurality of individually controllable light emitting elements arranged in a row extending parallel to the axis of rotation of the photoreceptor drum, said illumination emitting unit being so supported as to be movable between a first position, at which rays of light emitted from neighboring light emitting elements overlap with each other on the photoreceptor drum, and a second position at which rays of light emitted from neighboring light emitting elements abut each other on the drum without overlapping; and means for driving said illumination unit between the first and second position.

2. The charge eraser as claimed in claim 1, wherein said illumination emitting unit is supported for movement in a direction perpendicular to the axis of rotation of the photoreceptor drum, and wherein the first position is located away from the photoreceptor drum, relative to the second position, and the second position of the unit is located close to the photoreceptor drum, relative to the first position.

3. The charge eraser as claimed in claim 2, wherein the illumination emitting unit has a first light output portion including some of the light emitting elements and a second light output portion including the remaining light emitting elements, said first light output portion having a width, as measured in a direction parallel to the axis of rotation of the photoreceptor drum, larger than that of the second light output portion.

4. The charge eraser as claimed in claim 1, wherein said illumination emitting unit is supported for pivotal movement about an axis parallel to the axis of rotation of the photoreceptor drum, wherein: the second position is a position at which rays of light from said light emitting elements impinge upon the photoreceptor drum in a direction generally at right angles thereto; and the first position is a position at which rays of light impinge upon the photoreceptor drum at inclined angles.

5. The charge eraser as claimed in claim 4, wherein the illumination emitting unit has a first light output portion including some of the light emitting elements and a second light output portion including the remaining light emitting elements, said first light output portion having a width, as measured in a direction parallel to the axis of rotation of the photoreceptor drum, larger than that of the second light output portion.

6. A charge eraser for use in an electrophotographic copying machine for illuminating a predetermined area of a peripheral surface of a photoreceptor drum to lower the potential of such predetermined area, comprising:

an illuminating emitting unit including a plurality of individually controllable light emitting elements arranged in a row extending parallel to the axis of rotation of the photoreceptor drum, and in a condition wherein rays of light emitted from neighboring light emitting elements overlap with each other on the photoreceptor drum;

a movable lens array for avoiding diffusion of rays of light emitted from at least a part of the light emitting elements; and means for driving said lens array to a position in which the lens array is so arranged as to intervene between the photoreceptor drum and the illumination emitting unit, wherein rays of light emitted from neighboring light emitting elements abut each other on the drum without overlapping when the lens array is driven to the intervening position.

7. The charge eraser as claimed in claim 6, wherein the illumination emitting unit has a first light output portion including some of the light emitting elements and a second light output portion including the remaining light emitting elements, said first light output portion having a width, as measured in a direction parallel to the axis of rotation of the photoreceptor drum, larger than that of the second light output portion.

8. The charge eraser as claimed in claim 7, wherein said lens array is so arranged as to intervene between the photoreceptor drum and said second light output portion of the illumination emitting unit.

9. An improved charge eraser assembly for an electrophotographic copy machine having the capacity to provide, in a first mode of operation, a uniform erasure of a predetermined area of a photoreceptor drum and, in a second mode of operation, an imprinting of alphanumeric information on the photoreceptor drum, comprising:

an illumination emitting unit including a plurality of individually controllable light emitting elements arranged in a row extending parallel to an axis of the photoreceptor drum;

means for controlling the position of the emitted rays of light impacting on the photoreceptor drum from the light emitting elements wherein a first mode of operation causes the rays of light emitted from adjacent light emitting elements to overlap each other on the photoreceptor drum, and a second mode of operation causes the rays of light emitted from adjacent light emitting elements to abut each other on the photoreceptor drum without overlapping, and user control means for designating the first mode of operation to cause an overlap of light rays from adjacent light emitting elements and an erasure of a predetermined area of the photoreceptor drum and the second mode of operation to cause an abutting of light rays from adjacent light emitting elements to enable an imprinting operation of predetermined alphanumeric information.

10. The improved charge eraser of claim 9, wherein the user control means further includes an editor panel connected to the electrophotographic copying machine for determining the size of the predetermined area to be erased.

11. The improved charge eraser of claim 9, wherein the means for controlling the impact position of the emitted rays of light includes drive means for moving the illumination emitting unit relative to the photoreceptor drum.

12. The improved charge eraser of claim 9, wherein the means for controlling the impact position of the emitted rays of light includes a lens array movable into and out of the optical axes between the illumination emitting unit and the photoreceptor drum.

* * * * *